US005989090A

United States Patent [19]

Perrin et al.

[11] Patent Number: 5,989,090

[45] Date of Patent: Nov. 23, 1999

[54] METHOD OF MANUFACTURING SPACERS FOR FLAT VIEWING SCREENS

[75] Inventors: Aimé Perrin, St. Ismier; Jean-François Boronat, Grenoble, both of France

[73] Assignee: Commissariat A L'Energie Atomique, Paris, France

[21] Appl. No.: 09/085,712

[22] Filed: May 28, 1998

[30] Foreign Application Priority Data

Jun. 13, 1997 [FR] France ..... 97 07340

[51] Int. Cl.[6] ..... H01J 9/24

[52] U.S. Cl. ..... 445/24

[58] Field of Search ..... 445/24, 25

[56] References Cited

U.S. PATENT DOCUMENTS

| | | | |
|---|---|---|---|
| 5,503,582 | 4/1996 | Cathey, Jr. et al. . | |
| 5,561,343 | 10/1996 | Lowe | 445/24 |
| 5,600,203 | 2/1997 | Namikawa et al. . | |
| 5,785,569 | 7/1998 | Stansbury et al. | 445/24 |
| 5,842,897 | 12/1998 | Jeong et al. | 445/24 |

FOREIGN PATENT DOCUMENTS

| | | |
|---|---|---|
| 0 616 354 | 9/1994 | European Pat. Off. . |
| 0 780 873 | 6/1997 | European Pat. Off. . |
| 2 704 672 | 11/1994 | France . |
| WO 94/18694 | 8/1994 | WIPO . |
| WO 96/03764 | 2/1996 | WIPO . |
| WO 96/16429 | 5/1996 | WIPO . |
| WO 96/18204 | 6/1996 | WIPO . |
| WO 97/15912 | 5/1997 | WIPO . |

*Primary Examiner*—Kenneth J. Ramsey
*Attorney, Agent, or Firm*—Oblon, Spivak, McClleland, Maier & Neustadt, P.C.

[57] ABSTRACT

The invention relates to a method for collective manufacturing of spacers (35) for flat viewing screens with high voltage control and divided into picture elements or pixels (28), characterized in that it comprises the following steps:

machining a substrate, of an adequate material for making spacers, in view of obtaining a profile structure (30) with a cross section (32, 42, 52) comprising a center core (33, 43, 53) and lateral stiffeners (34, 44, 54), the thickness of the center core and the lateral stiffeners as well as the distance separating the lateral stiffeners being such that said section can be inserted between the screen pixels without overlapping them, cutting the profile structure (30) obtained during the preceding interval in view of obtaining sections of a given length, designed to form said spacers (35).

7 Claims, 3 Drawing Sheets

METHOD OF MANUFACTURING SPACERS FOR FLAT VIEWING SCREENS

This invention relates to a method of manufacturing spacers for flat viewing screens. Such spacers can be used, in particular, for cathodoluminescence viewing devices excited by field emission.

Figure 1:
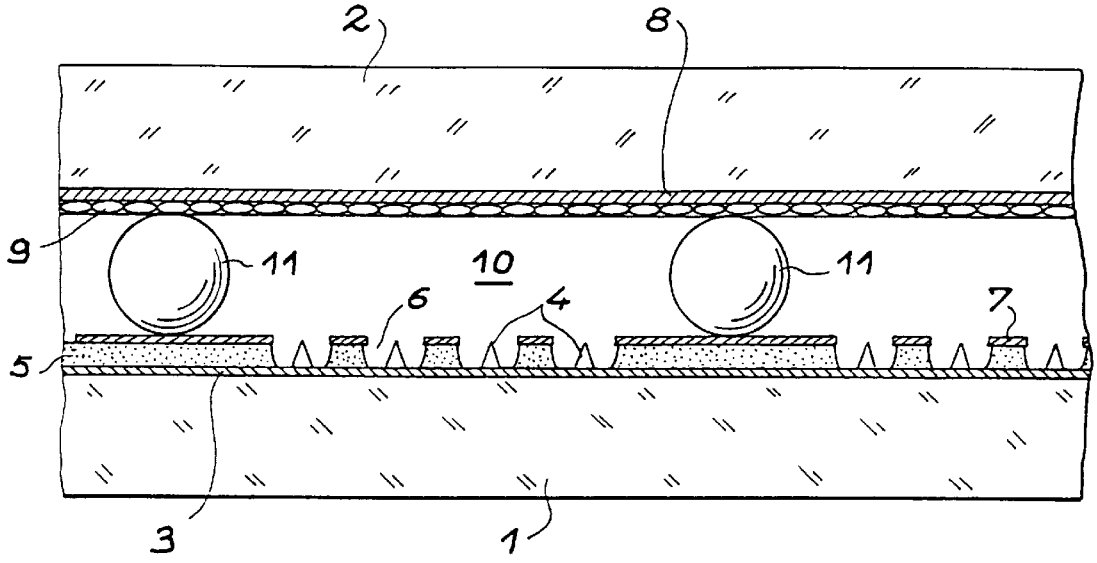

FIG. 1 shows a cross section of a field emission cathodoluminescence viewing device known in the art. Two glass plates 1 and 2 limit this screen shaped device. Plate 1 supports a cathode 3 with emitting pins 4. An insulating layer 5 is applied to the cathode 3 with holes 6 for disengaging the emitting pins 4. The insulating layer 5 is covered with a plating 7 used as an extraction grid for the electrons emitted by the pins 4. The plate 2 supports on its internal side, an electrode 8 used as an anode that supports in turn a layer 9 of cathodoluminescent material, also called luminophore.

If the device is to be viewed from plate 2, the electrode 8 must be transparent and is for instance made of oxide mixed with tin and indium (ITO electrode).

Plates 1 and 2 are maintained at a fixed distance from each other and are separated by a space 10 wherein a vacuum is established. The spacers 11 are for maintaining this fixed distance in spite of the atmospheric pressure to which the device's plates are subjected.

In field emission type flat screens, as the one shown in FIG. 1, it is important to maintain a high vacuum between the two plates. Thereby, the differential pressure with the outside creates a force that tends to crush the screen. For screens larger than a few centimeters, using spacers is mandatory. These spacers must have certain qualities. Of course, they must be able to resist the crushing due to the surrounding pressure. Their electrical resistance must be strong enough to avoid spark-overs between the electrodes located on either side of the inside space while this inside space is subject to potential differences reaching several hundred volts (typically 300 V) and which will further increase in future applications (up to several thousand volts). The spacers must be able to resist relatively high temperatures (about 400 to 450° C.) required for sealing the devices. Finally, these spacers must be thin enough to remain invisible for the user of the screen.

For existing field emission flat screens, i.e. operating at 300 V, the spacing between the two electrodes is about 200 $\mu$m. This spacing is obtained by means of spheres (as shown in FIG. 1) or by means of small glass columns distributed equally.

For devices designed to operate at higher voltage (several thousand volts), the spacing between the two plates must be increased. The spacing can then vary from 0.5 mm to several millimeters. In this case, the spheres, that should have the same diameter, are visible to the user of the screen. As for the small columns, they should keep their present diameter of 25 to 50 $\mu$m, their height would make them too fragile.

This problem is made even worse due to the fact that large screens use electron sources with matrix control micropins, which leaves little room for spacers.

Figure 2:
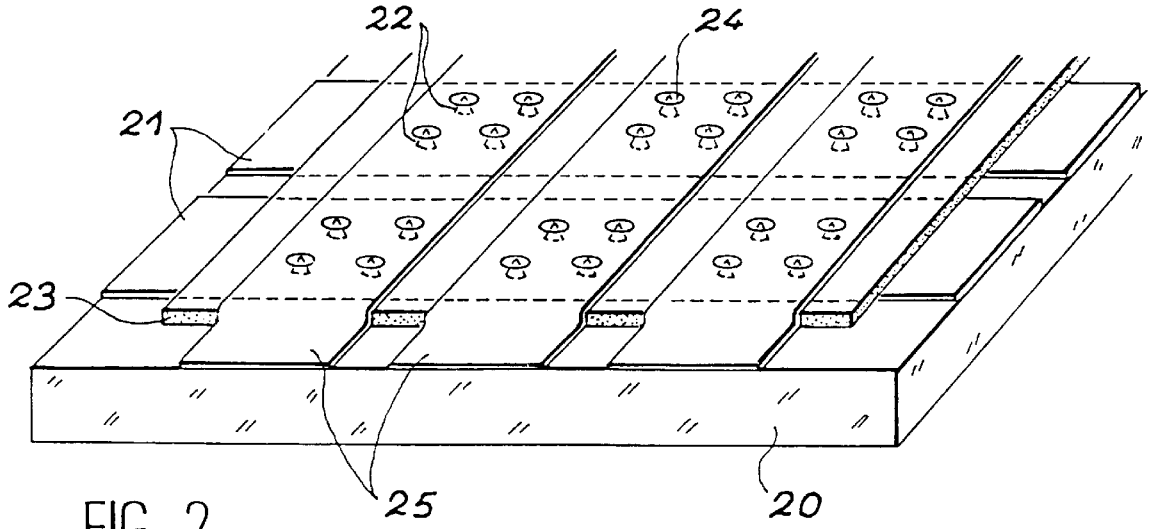

FIG. 2 shows a perspective view of such a micropin electron source. On one side of a glass plate 20, an array of conductive columns 21 has been applied for feeding the emitting pins 22, then the insulating layer 23. The holes 24 made in the insulating layer 23 allow for disengaging the micropins 22. The electron extraction grid consists of an array of conductive lines 25 perpendicular to the columns 21 and having holes aligning with the holes 24 of the insulating layer for disengaging the micropins 22. By adequately feeding a line and a column, an electron emission is obtained for the pins of the picture element (or pixel) located at the crossing of the corresponding line and column.

For the spacers that maintain the spacing between the two plates of the screen not to be hindering, they must either be placed in inter-line or inter-column spaces, or at the crossing of inter-line and inter-column spaces. This implies for the traditionally used spacers (spheres or columns) a diameter of several ten $\mu$m, typically 30 $\mu$m, for high resolution screens.

With the spacers known in the art, it is therefore not possible to obtain high resolution screens operating at high voltage, i.e. requiring a large spacing between plates.

This invention provides a solution to this problem.

The object of the invention is a method of manufacturing collective spacers for flat viewing screens with a high control voltage and divided into picture elements or pixels, characterized in that it comprises the following steps:

machining a substrate, of an adequate material for making spacers, in view of obtaining a profile structure with a cross section comprising a center core and lateral stiffeners, the thickness of the center core and the lateral stiffeners as well as the distance separating the lateral stiffeners being such that said section can be inserted between the screen pixels without overlapping them, cutting the profile structure obtained during the preceding step in view of obtaining sections of a given length, designed to form the said spacers.

The cutting step can comprise transversal and/or longitudinal cutting of the profile structure.

If the substrate used is of a material like silicon, photosensitive glass or quartz crystal, it can be machined using anisotropic die sinking.

The machining step can be performed for the said section to comprise a straight center core and the lateral stiffeners making up ribs grafted onto the center core. These lateral stiffeners may only be present on one side of the center core. They can also be arranged on both sides of the center core, either symmetrically with regard to the center core, or alternately along the center core.

Figure 3:
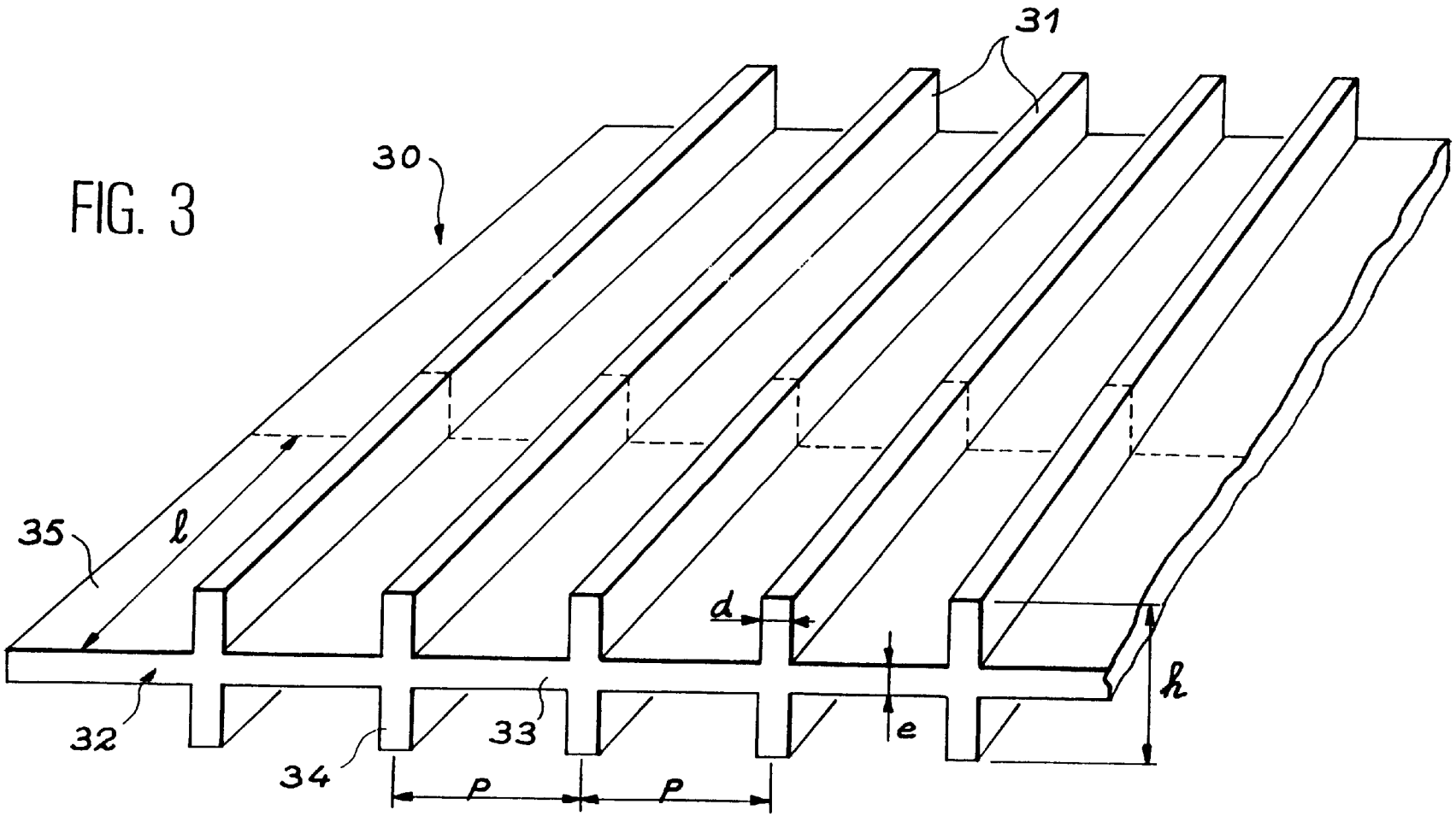
Figure 4:
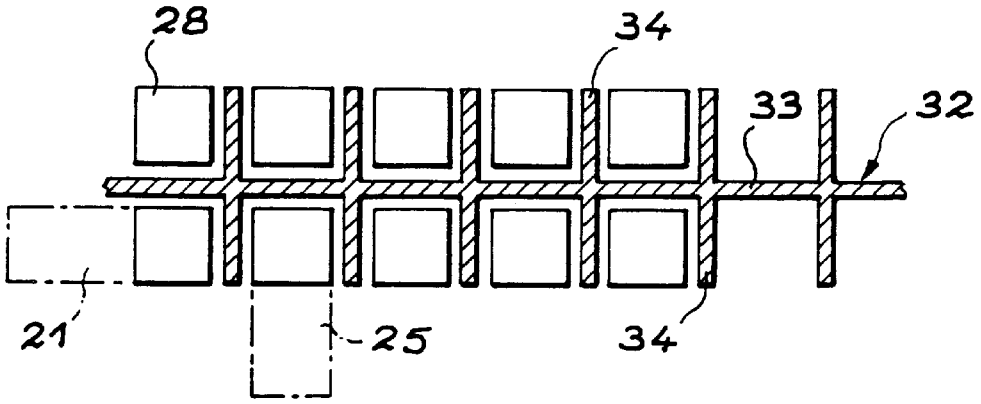
Figure 5:
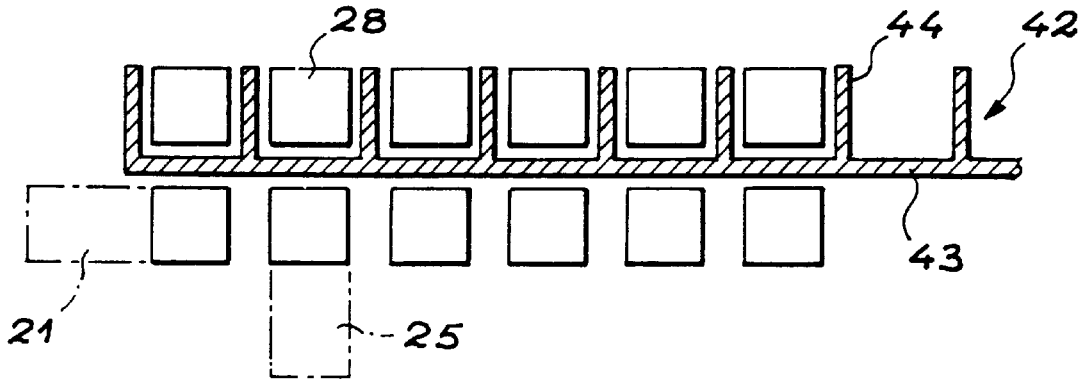
Figure 6:
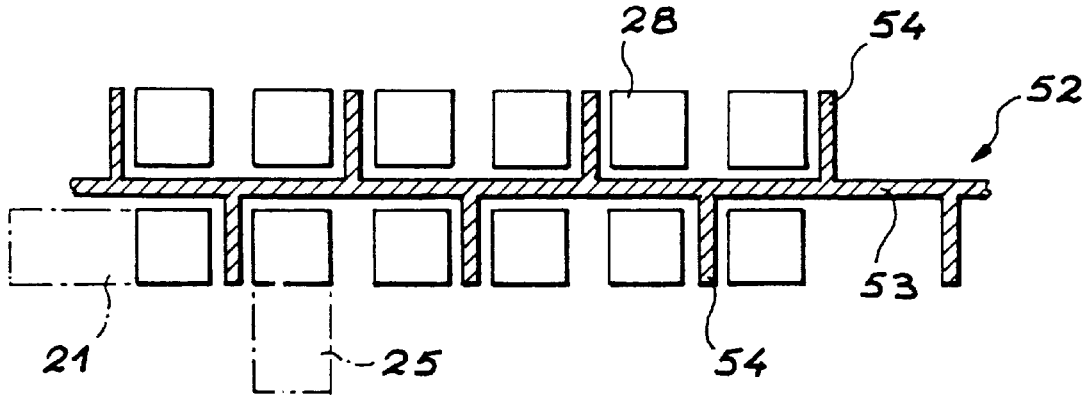

The invention will be better understood and further advantages and specific features will be apparent when reading the following description, provided by way of example and without being restrictive, in conjunction with the accompanying drawing where:

FIG. 1 is a cross sectional view of a field emission excited cathodoluminescence viewing device known in the art, FIG. 2 is a perspective view of an electron source with micropins and matrix control used for a viewing screen known in the art, FIG. 3 is a perspective view of a profile structure obtained at the end of the machining step of a substrate according to the method of the present invention, FIGS. 4 to 6 are views representing the spacer layout, obtained by the method according to the present invention, with regard to the pixels of a matrix access viewing screen.

FIG. 3 is a perspective view of a profile structure 30. It was obtained, e.g., by anisotropic die sinking of a silicon substrate. The substrate, with an initial thickness h, has been die sunk to reduce the thickness to the value e. Mutually parallel ribs 31 have been preserved. Their width is d and they are regularly spaced with an interval p.

Consequently, die sinking has made it possible to obtain a profile structure with a cross section 32 comprising a straight center core 33 and lateral stiffeners 34. The thickness h of the substrate, the thickness e of the center core, the width d of the ribs and their interval p are planned so that the section 32 can be inserted between the pixels of a flat viewing screen without overlapping them. In FIG. 3, the ribs 31 are perpendicular to the core 33 for the spacers to be used in a matrix access screen where pixels are square or rectangular shaped. For a screen with pixels of a different shape, e.g. hexagonal shape, the pitch of the ribs vs the center core must be provided accordingly.

The profile structure 30 is then cut up perpendicularly to the direction of the ribs 34 into strips 35 of a width 1. This width 1 corresponds to the spacing desired between the plates forming the flat viewing screen. The strips 35 can directly form the desired spacers, or else, if they are too long, can be cut again in parallel to the ribs 34 to produce shorter spacers.

FIGS. 4 to 6 schematically show the layout of the spacers according to the invention with regard to the pixels of a viewing screen. The pixels are shown as squares 28 representing the crossing of the addressing lines and columns. Consequently, FIGS. 4 to 6 correspond to a top view of the micropin electron source represented in perspective view in FIG. 2. Therefore, only one addressing line 21 and one addressing column 25 have been sketched with dot and dash lines.

FIG. 4 shows how the spacers 35 (seen in perspective in FIG. 3), only the cross-section shape 32 being visible, are inserted between pixels 28, i.e. into the inter-line and inter-column spaces. The length of the lateral stiffeners 34 may span several pixels.

FIG. 5 shows how to insert between the pixels 28 spacers with a section 42 comprising a center core 43 and stiffeners 44 located on one side only of the center core. The length of the lateral stiffeners may span several pixels.

FIG. 6 shows how to insert between the pixels 28 spacers with a section 52 comprising a center core 53 and lateral stiffeners 54 located alternately along the center core. As before, the length of the lateral stiffeners can span several pixels.

In FIGS. 4 to 6, the interval P of the ribs or the lateral stiffeners is the same as the pixel interval. The interval of the lateral stiffeners can also be a multiple of the pixel interval, this interval may also vary along an individual spacer.

We claim:

1. A method for manufacturing collective spacers for flat viewing screens with high voltage control and divided into picture elements or pixels, comprising the following steps:

machining a substrate, of an adequate material for making spacers, in view of obtaining a profile structure with a cross section comprising a center core and lateral stiffeners, the thickness of the center core and the lateral stiffeners as well as the distance separating the lateral stiffeners being such that said section can be inserted between the screen pixels without overlapping them, cutting the profile structure obtained during the preceding interval in view of obtaining sections of a given length, designed to form the said spacers.

2. A method according to claim 1, wherein the cutting interval comprises the transversal cutting of the profile structure.

3. A method according to claim 1, wherein the cutting interval comprises the longitudinal cutting of the profile structure.

4. A method according to claim 1, wherein the machining of the substrate is done by anisotropic die sinking, the substrate being of silicon, photosensitive glass or quartz crystal.

5. A method according to claim 1, characterized in that the machining interval is performed so that said section comprises a straight center core and that the lateral stiffeners form ribs grafted onto the center core.

6. A method according to claim 5, wherein the lateral stiffeners exist on one side only of the center core.

7. A method according to claim 5, wherein the lateral stiffeners are arranged on both sides of the center core, either symmetrically with regard to the center core, or alternately along the center core.

* * * * *